US011794490B2

(12) United States Patent
Aoyagi

(10) Patent No.: US 11,794,490 B2
(45) Date of Patent: Oct. 24, 2023

(54) INFORMATION PROCESSING APPARATUS, TAPE PRINTING APPARATUS, TAPE PRINTING SYSTEM, CONTROL METHOD OF INFORMATION PROCESSING APPARATUS, AND NON-TRANSITORY COMPUTER-READABLE STORAGE MEDIUM STORING PROGRAM

(71) Applicant: SEIKO EPSON CORPORATION, Tokyo (JP)

(72) Inventor: Naohiko Aoyagi, Azumino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 17/672,171

(22) Filed: Feb. 15, 2022

(65) Prior Publication Data

US 2022/0258494 A1 Aug. 18, 2022

(30) Foreign Application Priority Data

Feb. 16, 2021 (JP) ..... 2021-022338

(51) Int. Cl.
*B41J 3/407* (2006.01)
*B41J 3/46* (2006.01)
*B41J 15/04* (2006.01)

(52) U.S. Cl.
CPC ..... *B41J 3/4075* (2013.01); *B41J 3/46* (2013.01); *B41J 15/044* (2013.01)

(58) Field of Classification Search
None
See application file for complete search history.

(56) References Cited

U.S. PATENT DOCUMENTS

2009/0231608 A1 9/2009 Tsukuda

FOREIGN PATENT DOCUMENTS

| | | | | |
|---|---|---|---|---|
| CN | 1213613 | A | * | 4/1999 |
| JP | 2583622 | Y2 | | 10/1998 |
| JP | H11-105351 | A | | 4/1999 |
| JP | 2007-219614 | A | | 8/2007 |
| JP | 2009148984 | A | * | 7/2009 |
| JP | 2009-214482 | A | | 9/2009 |
| JP | 2017-098653 | A | | 6/2017 |

* cited by examiner

*Primary Examiner* — Matthew G Marini
(74) *Attorney, Agent, or Firm* — Oliff PLC

(57) ABSTRACT

An information processing apparatus coupled to and configured to communicate with a tape printing apparatus which prints a printing image on a tape fed from a tape cartridge includes: an acquiring section that acquires cartridge information indicating a type of the tape cartridge attached to the tape printing apparatus; a determining section that determines whether or not a shrinkable tape is loaded in the tape cartridge in accordance with the cartridge information; and a printing control section that, when the determining section determines that the shrinkable tape is not loaded in the tape cartridge, causes the tape printing apparatus to print a normal printing image and, when the determining section determines that the shrinkable tape is loaded in the tape cartridge, causes the tape printing apparatus to print an enlarged printing image to be printed on the tape as an enlarged image of the normal printing image.

9 Claims, 9 Drawing Sheets

INFORMATION PROCESSING APPARATUS, TAPE PRINTING APPARATUS, TAPE PRINTING SYSTEM, CONTROL METHOD OF INFORMATION PROCESSING APPARATUS, AND NON-TRANSITORY COMPUTER-READABLE STORAGE MEDIUM STORING PROGRAM

The present application is based on, and claims priority from JP Application Serial Number 2021-022338, filed Feb. 16, 2021, the disclosure of which is hereby incorporated by reference herein in its entirety.

BACKGROUND

1. Technical Field

The present disclosure relates to an information processing apparatus, a tape printing apparatus, a tape printing system, a control method of the information processing apparatus, and a non-transitory computer-readable storage medium storing a program.

2. Related Art

As disclosed in Japanese Utility Model No. 2,583,622, a tape printing apparatus that performs printing on a shrinkable tape that is shrunk to a predetermined memory shape by heating has been known.

Even when a tape cartridge in which a shrinkable tape is loaded is attached to the tape printing apparatus described in Japanese Utility Model No. 2,583,622, the tape printing apparatus prints the same printing image as a printing image obtained when a tape cartridge in which a normal non-shrinkable tape is loaded is attached. When a shrinkable label created from a shrinkable tape is attached to an attachment target and is shrunk by heating or the like, since a printing image printed on the shrinkable label is reduced, it is difficult for a user to view the printing image. Thus, an appropriate printing image is desired to be printed in accordance with a type of tape cartridge.

SUMMARY

An information processing apparatus of the disclosure is coupled to and configured to communicate with a tape printing apparatus to which a tape cartridge is attached and which prints a printing image on a tape fed from the tape cartridge, and the information processing apparatus includes: an acquiring section that acquires cartridge information indicating a type of the tape cartridge attached to the tape printing apparatus; a determining section that determines whether or not a shrinkable tape is loaded in the tape cartridge in accordance with the cartridge information; and a printing control section that, when the determining section determines that the shrinkable tape is not loaded in the tape cartridge, causes the tape printing apparatus to print a normal printing image and, when the determining section determines that the shrinkable tape is loaded in the tape cartridge, causes the tape printing apparatus to print an enlarged printing image to be printed on the tape as an enlarged image of the normal printing image.

A tape printing apparatus of the disclosure is a tape printing apparatus to which a tape cartridge is attached, and the tape printing apparatus includes: a printing section that prints a printing image on a tape fed from the tape cartridge; an acquiring section that acquires cartridge information indicating a type of the tape cartridge attached to the tape printing apparatus; a determining section that determines whether or not a shrinkable tape is loaded in the tape cartridge in accordance with the cartridge information; and a printing control section that, when the determining section determines that the shrinkable tape is not loaded in the tape cartridge, causes the printing section to print a normal printing image and, when the determining section determines that the shrinkable tape is loaded in the tape cartridge, causes the printing section to print an enlarged printing image to be printed on the tape as an enlarged image of the normal printing image.

A tape printing system of the disclosure is a tape printing system in which a tape printing apparatus, to which a tape cartridge is attached and which prints a printing image on a tape fed from the tape cartridge, and an information processing apparatus are coupled to and configured to communicate with each other, and the information processing apparatus includes an acquiring section that acquires cartridge information indicating a type of the tape cartridge attached to the tape printing apparatus, a determining section that determines whether or not a shrinkable tape is loaded in the tape cartridge in accordance with the cartridge information, and a printing control section that, when the determining section determines that the shrinkable tape is not loaded in the tape cartridge, causes the tape printing apparatus to print a normal printing image and, when the determining section determines that the shrinkable tape is loaded in the tape cartridge, causes the tape printing apparatus to print an enlarged printing image to be printed on the tape as an enlarged image of the normal printing image.

A control method of an information processing apparatus of the disclosure is a control method of an information processing apparatus coupled to and configured to communicate with a tape printing apparatus to which a tape cartridge is attached and which prints a printing image on a tape fed from the tape cartridge, and the method causes the information processing apparatus to execute a step of: acquiring cartridge information indicating a type of the tape cartridge attached to the tape printing apparatus; determining whether or not a shrinkable tape is loaded in the tape cartridge in accordance with the cartridge information; and when it is determined that the shrinkable tape is not loaded in the tape cartridge, causing the tape printing apparatus to print a normal printing image and, when it is determined that the shrinkable tape is loaded in the tape cartridge, causing the tape printing apparatus to print an enlarged printing image to be printed on the tape as an enlarged image of the normal printing image.

A non-transitory computer-readable storage medium storing a program of the disclosure causes an information processing apparatus coupled to and configured to communicate with a tape printing apparatus to which a tape cartridge is attached and which prints a printing image on a tape fed from the tape cartridge to execute a step of: acquiring cartridge information indicating a type of the tape cartridge attached to the tape printing apparatus; determining whether or not a shrinkable tape is loaded in the tape cartridge in accordance with the cartridge information; and when it is determined that the shrinkable tape is not loaded in the tape cartridge, causing the tape printing apparatus to print a normal printing image and, when it is determined that the shrinkable tape is loaded in the tape cartridge, causing the tape printing apparatus to print an enlarged printing image to be printed on the tape as an enlarged image of the normal printing image.

DESCRIPTION OF EXEMPLARY EMBODIMENTS

An information processing apparatus, a tape printing apparatus, a tape printing system, a control method of the information processing apparatus, and a non-transitory computer-readable storage medium storing a program will be described below with reference to the accompanying drawings. Note that, although the XYZ orthogonal coordinate system is indicated in FIGS. 3 to 6, 8, and 9, the system is used merely for convenience of description and does not limit the following embodiment.

Figure 1:
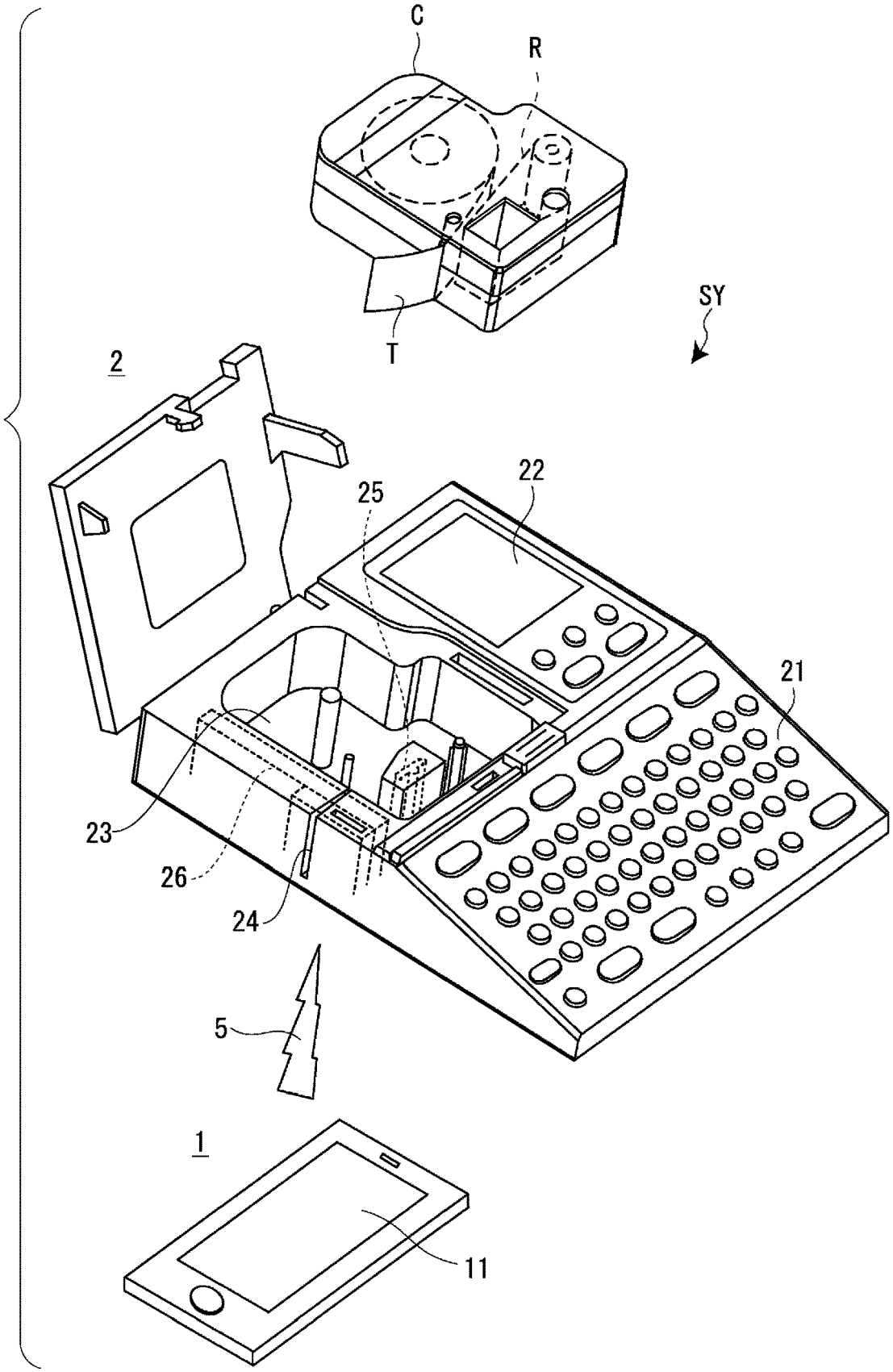
FIG. 1 is an external view of a portable terminal and a tape printing apparatus included in a tape printing system.

FIG. 1 is an external view of a portable terminal 1 and a tape printing apparatus 2 included in a tape printing system SY. The portable terminal 1 is an example of the information processing apparatus. The tape printing system SY includes the portable terminal 1 and the tape printing apparatus 2, which are coupled to each other via wireless communication 5. Note that the portable terminal 1 and the tape printing apparatus 2 are not necessarily coupled to each other via the wireless communication 5 and may be coupled in a wired manner via a cable or the like.

Figure 2:
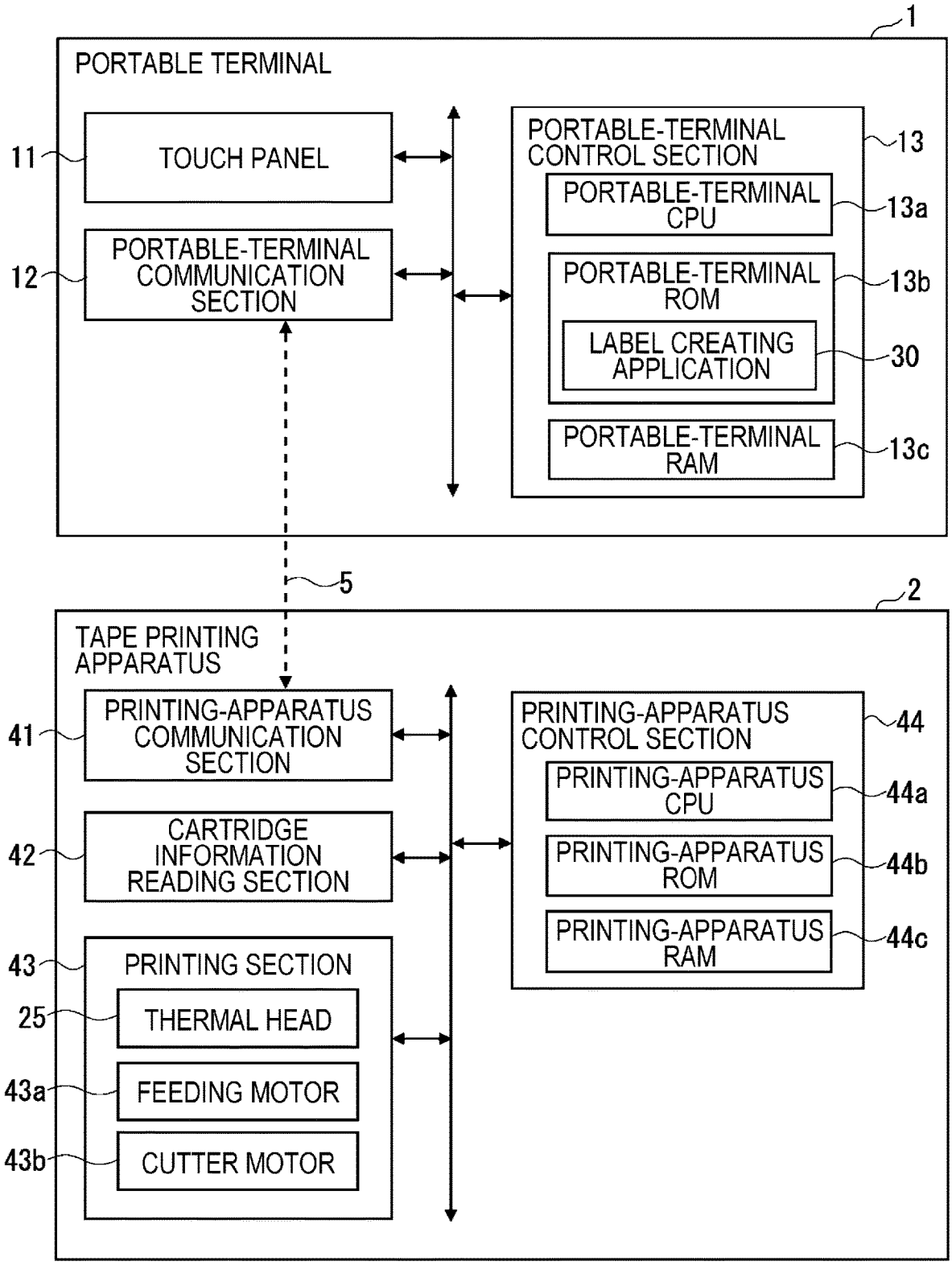
FIG. 2 is a block diagram illustrating hardware configurations of the portable terminal and the tape printing apparatus.

The portable terminal 1 includes a touch panel 11. The touch panel 11 is an example of a display section. As illustrated in FIG. 2, a label creating application 30 for creating a label in cooperation with the tape printing apparatus 2 is installed in the portable terminal 1. The label creating application 30 is an example of the non-transitory computer-readable storage medium storing the program. The portable terminal 1 generates printing data for creating a label by using the label creating application 30 and transmits the generated printing data to the tape printing apparatus 2. Note that, although FIG. 1 illustrates a smartphone as the portable terminal 1, a tablet terminal, a notebook personal computer (PC), or the like may be used.

The tape printing apparatus 2 includes a keyboard 21, a display 22, a cartridge attachment section 23, and a tape discharging port 24.

The keyboard 21 receives input of various operations, such as editing of a printing image. The display 22 displays various kinds of information, such as an editing screen for editing a printing image. A tape cartridge C is detachably attached to the cartridge attachment section 23. A tape T and an ink ribbon R are loaded in a case of the tape cartridge C.

A thermal head 25 is provided in the cartridge attachment section 23. In a state in which the tape cartridge C is attached to the cartridge attachment section 23, the thermal head 25 is driven to generate heat in accordance with the result of editing of the printing image. Ink of the ink ribbon R is thereby transferred onto the tape T, and the printing image is printed on the tape T.

The printed tape T is discharged from the tape discharging port 24. A cutter 26 is provided between the cartridge attachment section 23 and the tape discharging port 24. The cutter 26 cuts the tape T in a width direction. A printed portion of the tape T is thereby cut off. The printed portion of the tape T, which has been cut off, is used as a label.

Note that the tape printing apparatus 2 is able to perform printing in accordance with the result of editing the printing image with the keyboard 21 and also printing in accordance with printing data transmitted from the portable terminal 1. In the present embodiment, description will be given for an instance in which the tape printing apparatus 2 performs printing as in the latter case, in other words, printing in accordance with printing data transmitted from the portable terminal 1.

FIG. 2 is a block diagram illustrating hardware configurations of the portable terminal 1 and the tape printing apparatus 2. The portable terminal 1 includes the touch panel 11, a portable-terminal communication section 12, and a portable-terminal control section 13.

The touch panel 11 receives input of various user operations and displays various kinds of information. For example, the touch panel 11 displays a printing image selection screen D1 illustrated in FIG. 11 and a diameter input screen D2 illustrated in FIG. 12. The printing image selection screen D1 is an example of a selection screen. The diameter input screen D2 is an example of an input screen. The printing image selection screen D1 is a screen enabling a user to select whether to print a normal printing image G1 illustrated in FIG. 8 or an enlarged printing image G2 illustrated in FIG. 9 as a printing image. The enlarged printing image G2 is an image printed on a thermally shrinkable tape, which is a thermally shrinkable tape T that is shrunk by heating, and is printed on the tape T as an enlarged image of the normal printing image G1. In the present embodiment, a tube tape T2 (refer to FIG. 4) is exemplified as the thermally shrinkable tape. The tube tape T2 is a tape for creating a tube label L2 illustrated in FIG. 5 and the like. The diameter input screen D2 will be described later.

The portable-terminal communication section 12 communicates with the tape printing apparatus 2 via the wireless communication 5. For example, the portable-terminal communication section 12 transmits printing data to the tape printing apparatus 2 and receives, from the tape printing apparatus 2, cartridge information indicating a type of the tape cartridge C attached to the tape printing apparatus 2.

The portable-terminal control section 13 includes a portable-terminal central processing unit (CPU) 13*a*, portable-terminal read-only memory (ROM) 13*b*, and portable-terminal random access memory (RAM) 13*c*.

The portable-terminal CPU 13*a* performs various kinds of control by loading various control programs stored in the portable-terminal ROM 13*b* into the portable-terminal RAM 13*c* and executing the control programs. Note that the portable-terminal control section 13 may use a hardware circuit, such as an application specific integrated circuit (ASIC), as a processor instead of the portable-terminal CPU 13*a*. Moreover, the processor may be configured such that one or more CPUs and a hardware circuit, such as an ASIC, cooperate with each other.

The portable-terminal ROM 13*b* is rewritable ROM and stores various control programs and various kinds of control data. For example, the portable-terminal ROM 13*b* stores the label creating application 30. The label creating application 30 is an application program for creating various labels, such as a normal label (not illustrated) and the tube label L2 illustrated in FIG. 5 and the like. The normal label is created by using a normal tape T1 illustrated in FIG. 3. The tube label L2 is created by using the tube tape T2 illustrated in FIG. 4.

Figure 3:
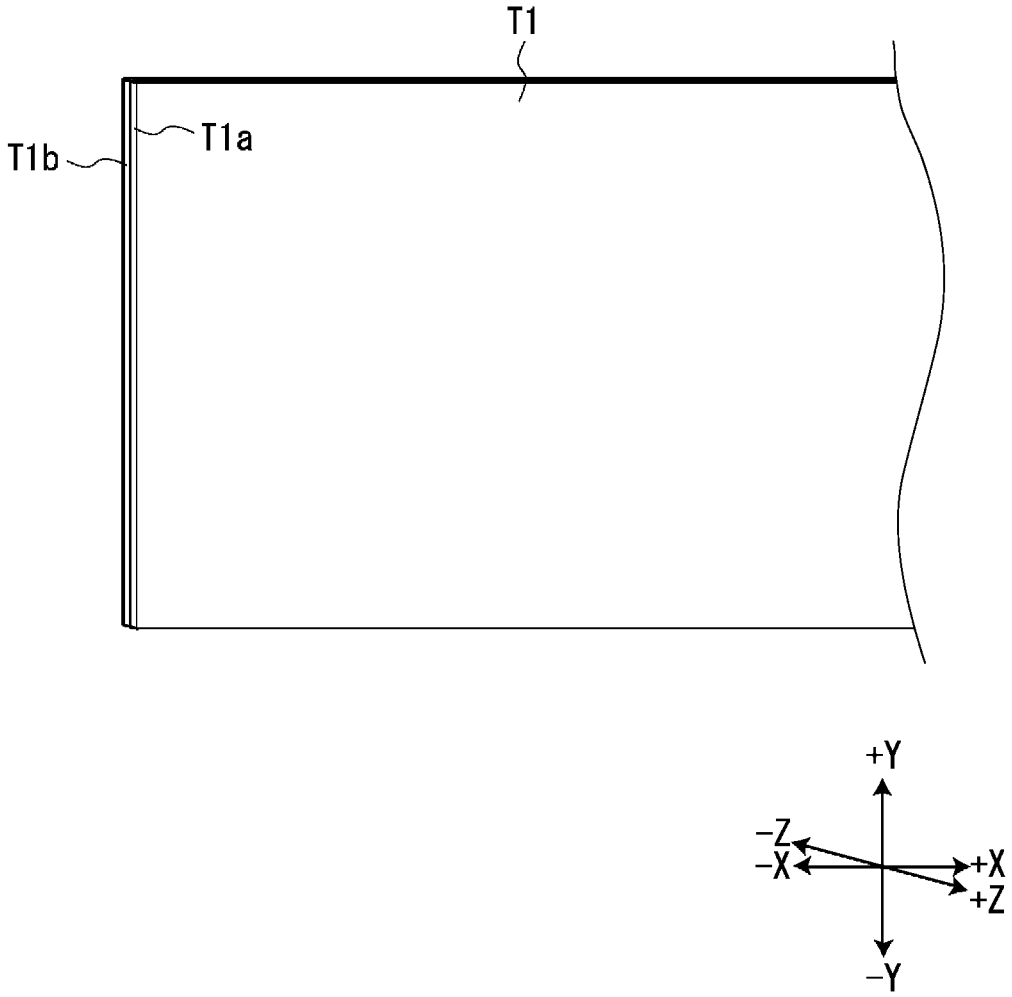
FIG. 3 is an external view of a normal tape.

Next, how to use the normal tape T1, the tube tape T2, and the tube label L2 will be described. FIG. 3 is an external view of the normal tape T1. In FIG. 3, the X direction corresponds to a length direction of the tape T, the Y direction corresponds to a width direction of the tape T, and the Z direction corresponds to a thickness direction of the tape T. The normal tape T1 includes a printing layer T1*a* and a release-paper layer T1*b* provided in the −Z direction relative to the printing layer T1*a*. The +Z direction surface of the printing layer T1*a* is a printing surface, and the −Z direction surface of the printing layer T1*a* is an adhesive surface to which an adhesive is applied. In the normal label created by using the normal tape T1, the release-paper layer T1*b* is peeled from the printing layer T1*a*, and the printing layer T1*a* is attached to an attachment target 200.

Figure 4:
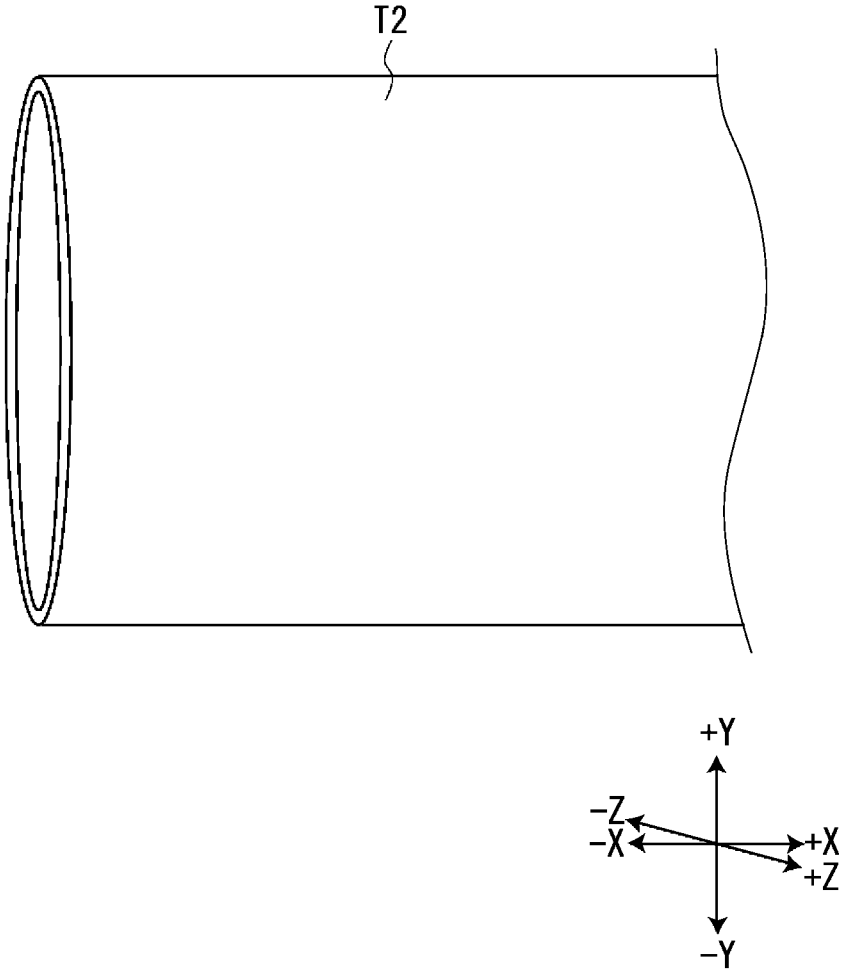
FIG. 4 is an external view of a tube tape.

FIG. 4 is an external view of the tube tape T2. The tube tape T2 has a tubular structure open in the X direction and is in a state of being squashed flat in the Z direction before a printing image is printed. The tube tape T2 is manufactured by a thermally shrinkable material, such as a thermally shrinkable resin film. In the present embodiment, the tube tape T2 that is thermally shrunk not in the X direction but only in the Y direction is exemplified.

Figure 5:
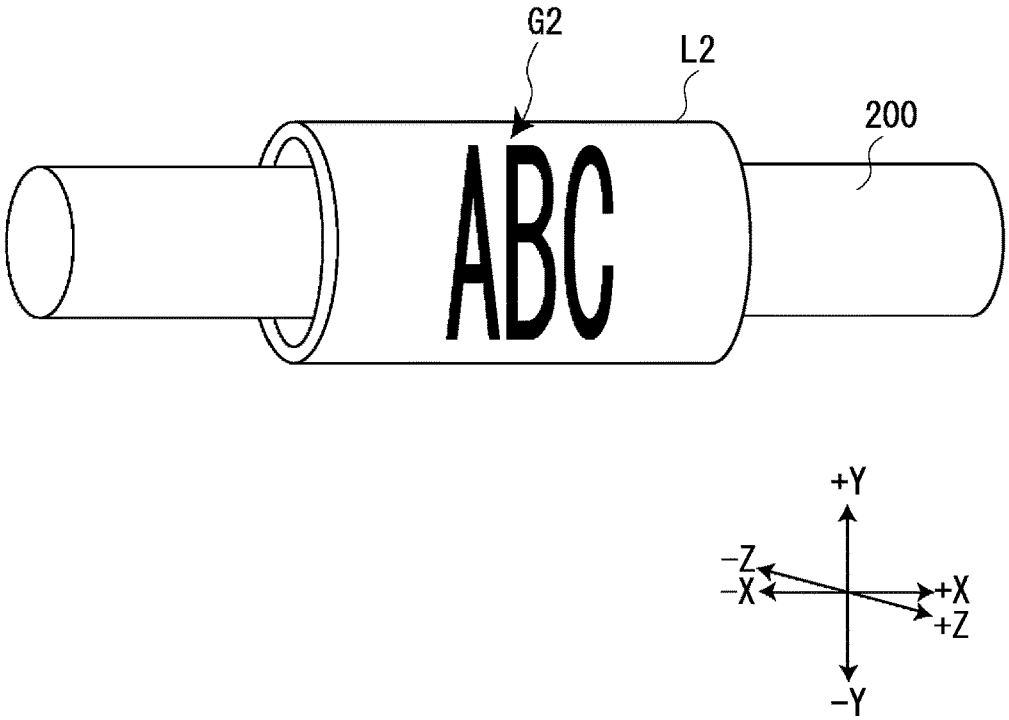
FIG. 5 illustrates a state in which an attachment target is inserted into a tube label that has not been thermally shrunk.

Next, how to use the tube label L2 created by using the tube tape T2 will be described with reference to FIGS. 5 and 6. The tube label L2 is a label attached to the attachment target 200 having a column shape or a prism shape, such as a cable or a pipe. The following description will be given by assuming that the attachment target 200 has a column shape. FIG. 5 illustrates a state in which the attachment target 200 is inserted into the tube label L2 that has not been thermally shrunk. FIG. 5 also illustrates a state in which the enlarged printing image G2 is printed on the tube label L2. In the example of FIG. 5, the enlarged printing image G2 obtained by enlarging the normal printing image G1 illustrated in FIG. 8 twice in the Y direction is printed on the tube tape T2.

Figure 6:
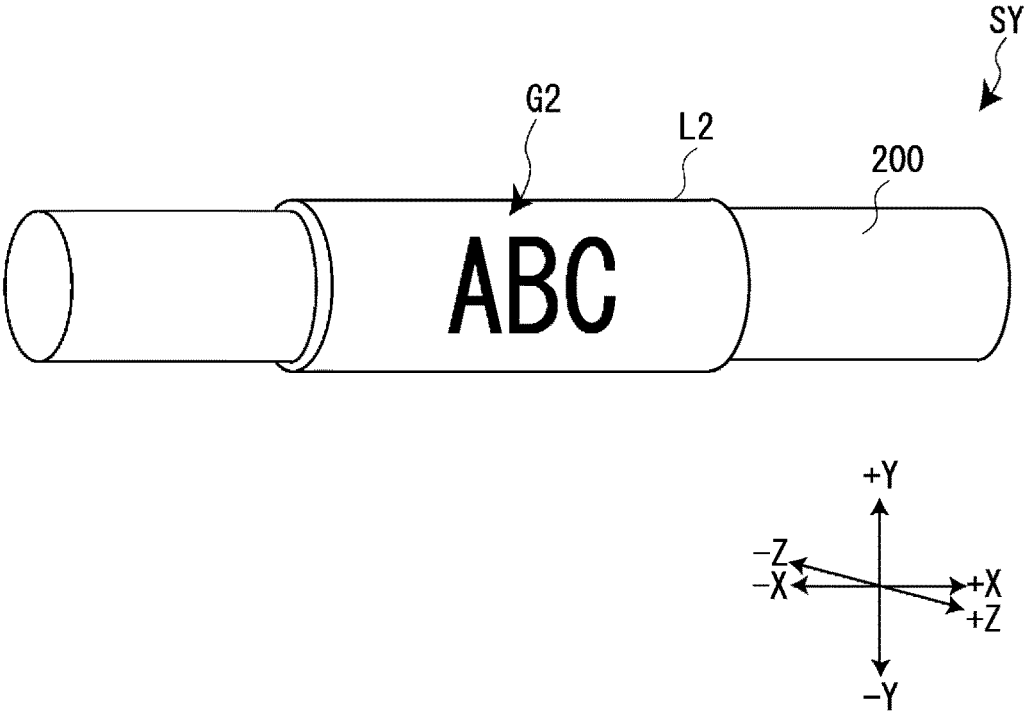
FIG. 6 illustrates a state in which the tube label has been thermally shrunk with the attachment target inserted thereinto.

FIG. 6 illustrates a state in which the tube label L2 has been thermally shrunk with the attachment target 200 inserted thereinto. The tube label L2 is thermally shrunk by being heated with a dryer or the like, and an inner surface of the tube label L2 is fixed to a peripheral surface of the attachment target 200. Moreover, when the tube label L2 is thermally shrunk, the enlarged printing image G2 printed on the tube label L2 is also thermally shrunk. In the example of FIG. 6, the enlarged printing image G2 is shrunk to half in the Y direction when the tube label L2 is thermally shrunk. In this manner, in a state in which the tube label L2 is thermally shrunk, the enlarged printing image G2 having the same aspect ratio as the aspect ratio of the normal printing image G1 is printed on the tube label L2.

Description will be given with reference to FIG. 2. The tape printing apparatus 2 includes a printing-apparatus communication section 41, a cartridge information reading section 42, a printing section 43, and a printing-apparatus control section 44.

The printing-apparatus communication section 41 communicates with the portable terminal 1 via the wireless communication 5.

The cartridge information reading section 42 includes an optical reading section (not illustrated) optically reading a code image printed on the case of the tape cartridge C or attached thereto as a label and reads cartridge information by decoding the image read by using the optical reading section. The cartridge information includes information indicating a type of the tape T loaded in the tape cartridge C. For example, the cartridge information includes information such as normal tape and tube tape.

The printing section 43 is a mechanism for performing printing on the tape T and includes the thermal head 25, a feeding motor 43*a*, and a cutter motor 43*b*. The thermal head 25 includes a plurality of heating elements and performs printing by thermally transferring ink onto the tape T from the ink ribbon R. The feeding motor 43*a* is a drive source for feeding the tape T and the ink ribbon R. The cutter motor 43*b* is a drive source for driving the cutter 26.

The printing-apparatus control section 44 includes a printing-apparatus CPU 44*a*, printing-apparatus ROM 44*b*, and printing-apparatus RAM 44*c*.

The printing-apparatus CPU 44*a* performs various kinds of control by loading various control programs stored in the printing-apparatus ROM 44*b* into the printing-apparatus RAM 44*c* and executing the control programs. Note that the printing-apparatus control section 44 may use a hardware circuit, such as an ASIC, as a processor instead of the printing-apparatus CPU 44*a*. Moreover, the processor may be configured such that one or more CPUs and a hardware circuit, such as an ASIC, cooperate with each other.

The printing-apparatus ROM 44*b* stores various control programs, such as firmware. The printing-apparatus CPU 44*a* uses a control program stored in the printing-apparatus ROM 44*b* to perform printing on the tape T in accordance with printing data transmitted from the portable terminal 1. When a cartridge information request signal is received from the portable terminal 1 or when the tape cartridge C is replaced, the printing-apparatus CPU 44*a* acquires cartridge information from the code image on the tape cartridge C via the cartridge information reading section 42 and transmits the acquired cartridge information to the portable terminal 1.

Figure 7:
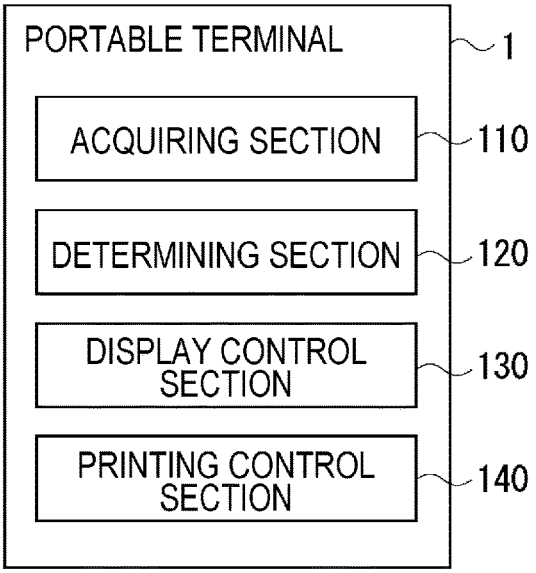
FIG. 7 is a block diagram illustrating a functional configuration of the portable terminal.

FIG. 7 is a block diagram illustrating a functional configuration of the portable terminal 1. The functional configuration of the portable terminal 1 includes an acquiring section 110, a determining section 120, a display control section 130, and a printing control section 140. All the functions thereof are achieved when the portable-terminal CPU 13*a* executes the label creating application 30.

The acquiring section 110 acquires cartridge information indicating a type of the tape cartridge C attached to the tape printing apparatus 2 from the tape printing apparatus 2. In the present embodiment, when a printing image is edited by the user and when the user gives an instruction to print the printing image, the acquiring section 110 transmits a cartridge information request signal to the tape printing apparatus 2 and acquires the cartridge information from the tape printing apparatus 2.

The determining section 120 determines whether or not the tube tape T2 is loaded in the tape cartridge C attached to the tape printing apparatus 2 in accordance with the cartridge information acquired by the acquiring section 110.

Figure 11:
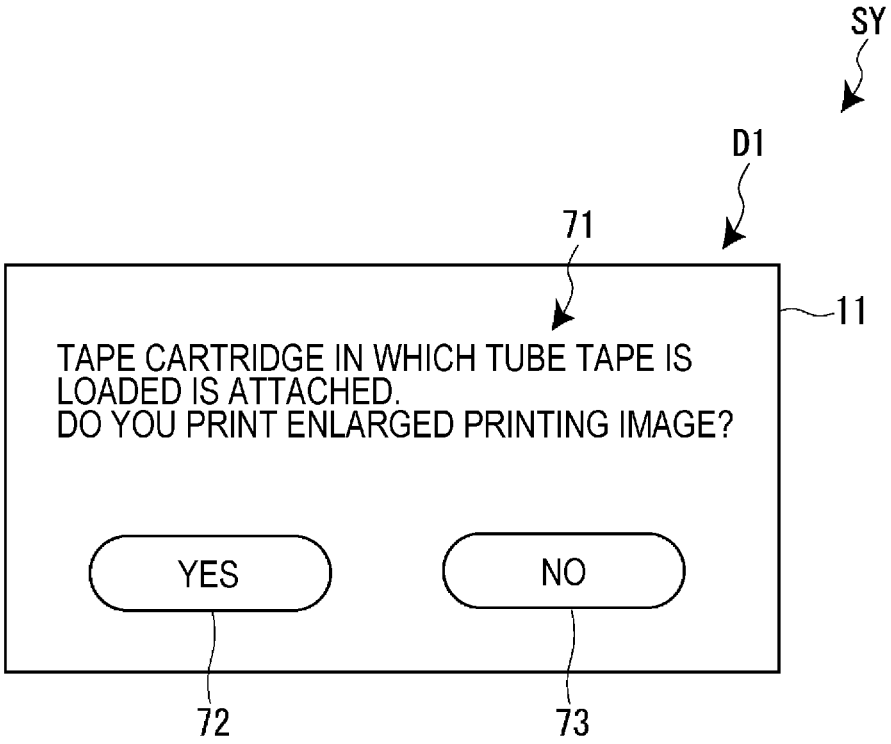
FIG. 11 illustrates an example of display of a printing image selection screen.

When the determining section 120 determines that the tube tape T2 is loaded in the tape cartridge C, the display control section 130 causes the touch panel 11 to display the printing image selection screen D1 illustrated in FIG. 11 to enable the user to select whether to print the normal printing image G1 or the enlarged printing image G2. When printing of the enlarged printing image G2 is selected on the printing image selection screen D1, the display control section 130 causes the touch panel 11 to display the diameter input screen D2 illustrated in FIG. 12 to enable the user to input the diameter of the attachment target 200. The diameter of the attachment target 200 is an example of a size of an attachment target or enlargement ratio information. The diameter of the attachment target 200 is information for determining an enlargement ratio of the enlarged printing image G2 in the Y direction with respect to the normal printing image G1.

When printing of the normal printing image G1 is selected on the printing image selection screen D1, the printing control section 140 causes the tape printing apparatus 2 to print the normal printing image G1. When printing of the enlarged printing image G2 is selected on the printing image selection screen D1, the printing control section 140 causes the tape printing apparatus 2 to print the enlarged printing image G2. When causing the tape printing apparatus 2 to print the enlarged printing image G2, the printing control section 140 generates printing data for printing the enlarged printing image G2 by performing enlargement processing for enlarging the normal printing image G1, which is obtained in accordance with the result of editing of the printing image, in the Y direction and transmits the generated printing data to the tape printing apparatus 2.

Moreover, the printing control section 140 determines the enlargement ratio in the Y direction for the enlargement processing described above in accordance with the diameter of the attachment target 200, which is input via the diameter input screen D2. Specifically, when a smaller diameter is input via the diameter input screen D2, the printing control section 140 sets a greater enlargement ratio for the enlargement processing. This is because thermal shrinkage of the tube label L2 is greater when the attachment target 200 having a small diameter is inserted than when the attachment target 200 having a large diameter is inserted.

Figure 8:
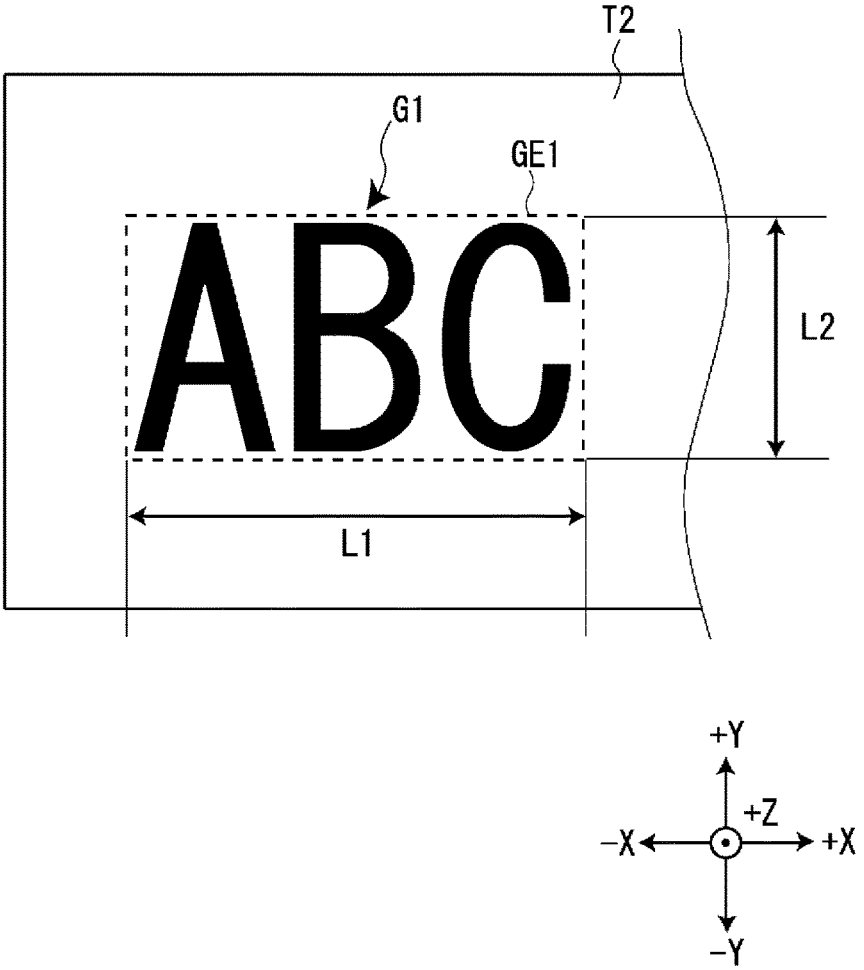
FIG. 8 illustrates an example of printing of a normal printing image.

Next, the enlargement processing will be further described with reference to FIGS. 8 and 9. FIG. 8 illustrates the normal printing image G1 printed on the tube tape T2. As illustrated in FIG. 8, a dimension of an image region GE1 of the normal printing image G1 including characters "ABC" in the X direction is dimension L1, and a dimension thereof in the Y direction is dimension L2.

Figure 9:
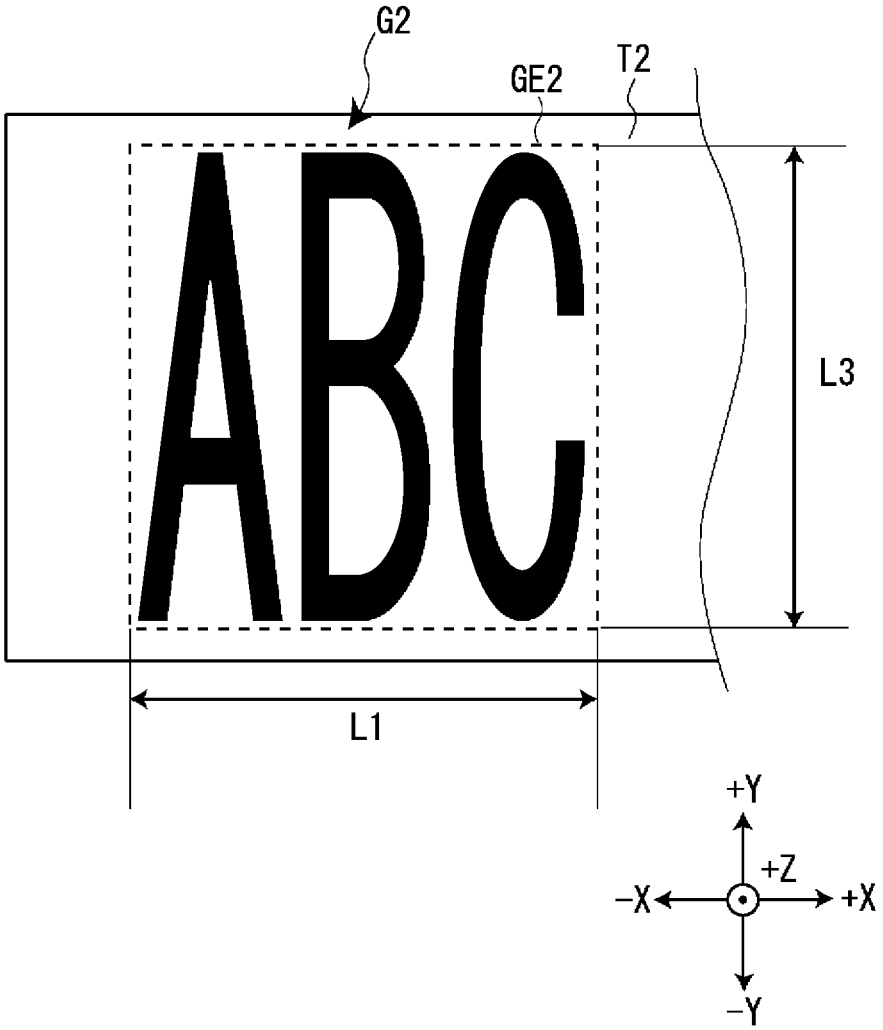
FIG. 9 illustrates an example of printing of an enlarged printing image.

FIG. 9 illustrates the enlarged printing image G2 obtained by performing enlargement processing for the normal printing image G1 illustrated in FIG. 8. A dimension of an image region GE2 of the enlarged printing image G2 in the X direction is dimension L1, which is the same as dimension L1 of the image region GE1 of the normal printing image G1 in the X direction. In this manner, the portable terminal 1 does not perform enlargement processing in the X direction. Meanwhile, a dimension of the image region GE2 of the enlarged printing image G2 in the Y direction is dimension L3, which is longer than dimension L2 of the image region GE1 of the normal printing image G1 in the Y direction. Dimension L3 is obtained by multiplying dimension L2 by an enlargement ratio determined by the printing control section 140.

Figure 10:
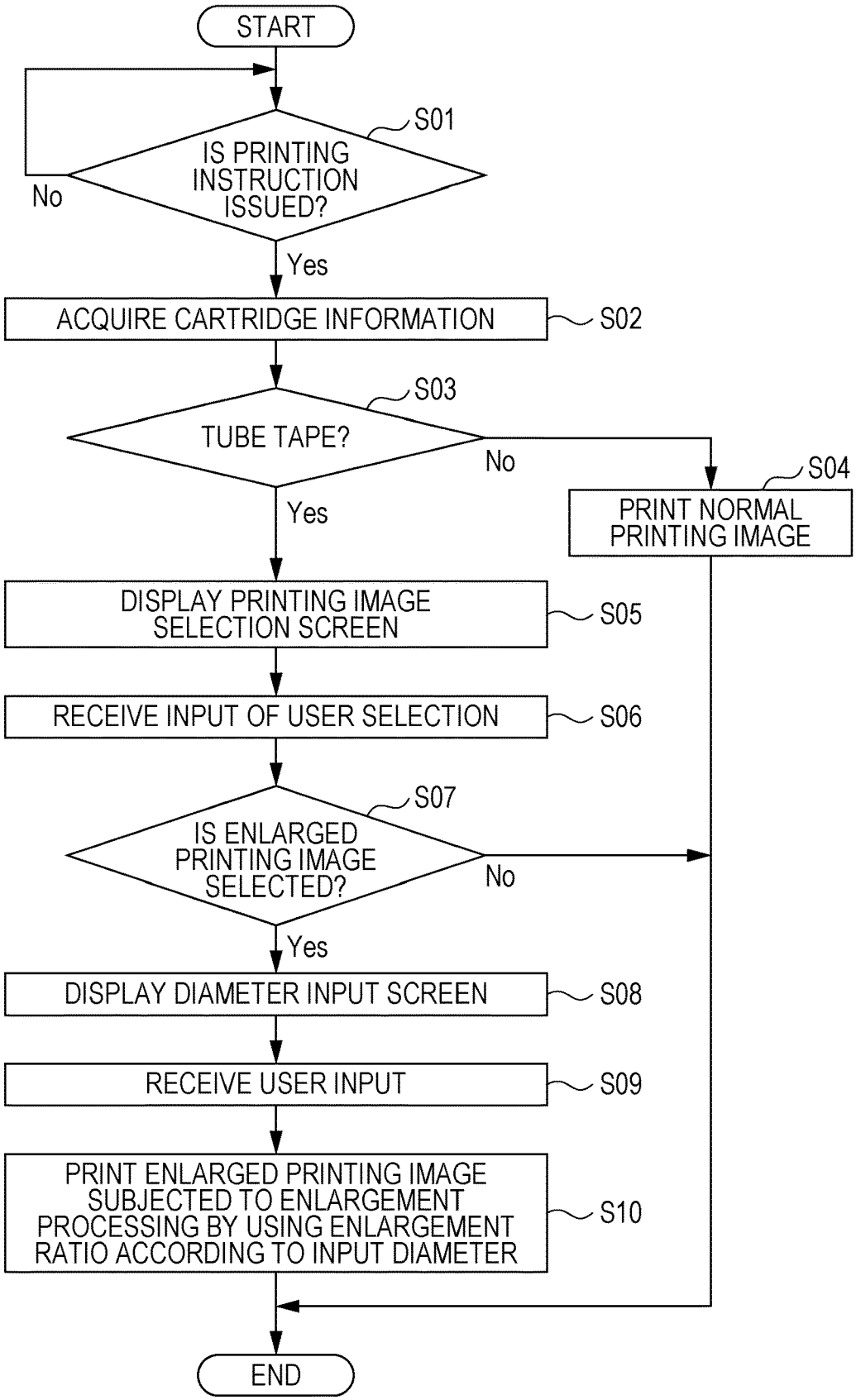
FIG. 10 is a flowchart illustrating a flow of printing instruction processing performed by the portable terminal.

A flow of printing instruction processing performed by the portable terminal 1 will be described with reference to the flowchart of FIG. 10. Note that it is assumed that the user has completed editing of a printing image before the start of the flowchart of FIG. 10.

In step S01, the portable terminal 1 determines whether or not an instruction to print a printing image is issued. When the portable terminal 1 determines that an instruction to print a printing image is issued, the procedure proceeds to step S02. When the portable terminal 1 determines that an instruction to print a printing image is not issued, step S01 is repeated.

In step S02, the portable terminal 1 transmits a cartridge information request signal to the tape printing apparatus 2 and thereby acquires cartridge information from the tape printing apparatus 2.

In step S03, the portable terminal 1 determines whether or not the tube tape T2 is loaded in the tape cartridge C attached to the tape printing apparatus 2 in accordance with the cartridge information acquired from the tape printing apparatus 2. When the portable terminal 1 determines that the tube tape T2 is loaded in the tape cartridge C, the procedure proceeds to step S05. When the portable terminal 1 determines that the tube tape T2 is not loaded in the tape cartridge C, the procedure proceeds to step S04.

In step S04, the portable terminal 1 causes the tape printing apparatus 2 to print the normal printing image G1. That is, the portable terminal 1 generates printing data for printing the normal printing image G1 and transmits the generated printing data to the tape printing apparatus 2. After step S04, the portable terminal 1 ends the printing instruction processing.

In step S05, the portable terminal 1 displays the printing image selection screen D1 illustrated in FIG. 11 on the touch panel 11.

In step S06, the portable terminal 1 receives input of a user selection via the printing image selection screen D1.

In step S07, the portable terminal 1 determines whether or not printing of the enlarged printing image G2 is selected on the printing image selection screen D1. When the portable terminal 1 determines that printing of the enlarged printing image G2 is selected on the printing image selection screen D1, the procedure proceeds to step S08. When the portable terminal 1 determines that printing no enlarged printing image G2 is selected on the printing image selection screen D1, the procedure proceeds to step S04.

Figure 12:
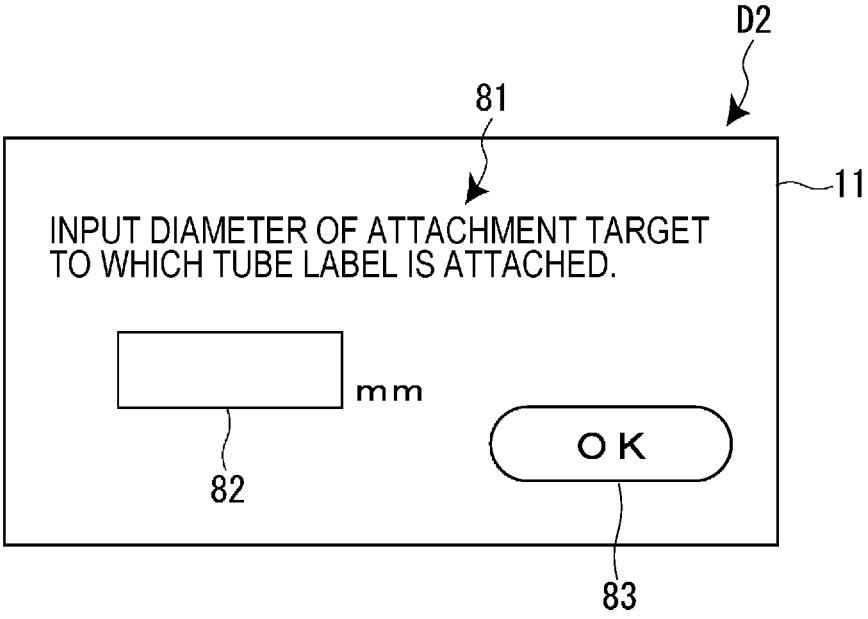
FIG. 12 illustrates an example of display of a diameter input screen.

In step S08, the portable terminal 1 displays the diameter input screen D2 illustrated in FIG. 12 on the touch panel 11.

In step S09, the portable terminal 1 receives user input via the diameter input screen D2.

In step S10, the portable terminal 1 causes the tape printing apparatus 2 to print the enlarged printing image G2 subjected to enlargement processing by using the enlargement ratio according to the diameter of the attachment target 200, which is input via the diameter input screen D2. That is, the portable terminal 1 determines the enlargement ratio in the Y direction in accordance with the diameter of the attachment target 200, which is input via the diameter input screen D2, performs enlargement processing for the normal printing image G1 by using the determined enlargement ratio to thereby generate printing data for printing the enlarged printing image G2, and transmits the generated printing data to the tape printing apparatus 2. The portable terminal 1 ends the printing instruction processing after step S10.

FIG. 11 illustrates an example of display of the printing image selection screen D1. The printing image selection screen D1 displays a first message 71, a YES button 72, and a NO button 73. The first message 71 includes a message for notifying the user that the tape cartridge C in which the tube tape T2 is loaded is attached to the tape printing apparatus 2 and a message for prompting the user to select whether or not to print the enlarged printing image G2. When the YES button 72 is selected on the printing image selection screen D1, the portable terminal 1 determines that printing of the enlarged printing image G2 is selected. When the NO button 73 is selected on the printing image selection screen D1, the portable terminal 1 determines that printing no enlarged printing image G2 is selected.

FIG. 12 illustrates an example of display of the diameter input screen D2. The diameter input screen D2 displays a second message 81, an input box 82, and an OK button 83. The second message 81 includes a message for prompting the user to input the diameter of the attachment target 200 to which the tube label L2 is attached. When the OK button 83 is selected after a numerical value is input in the input box 82, the portable terminal 1 acquires the numerical value, which is input in the input box 82, as a numerical value indicating the diameter of the attachment target 200.

As described above, when determining that the tube tape T2 is loaded in the tape cartridge C attached to the tape printing apparatus 2, the portable terminal 1 according to the present embodiment displays, on the touch panel 11, the printing image selection screen D1 enabling the user to select whether to print the normal printing image G1 or the enlarged printing image G2. In this manner, when the tube tape T2 is loaded in the tape cartridge C, the portable terminal 1 notifies the user that the tube tape T2 is loaded, and the user is thus able to check that the tape cartridge C in which the tube tape T2 is loaded is attached to the tape printing apparatus 2. When the tube tape T2 is loaded in the tape cartridge C, the user is able to select printing of the enlarged printing image G2 and is thus able to cause the tape printing apparatus 2 to print an appropriate printing image in accordance with a type of the tape cartridge C.

When printing of the enlarged printing image G2 is selected on the printing image selection screen D1, the portable terminal 1 displays the diameter input screen D2 on the touch panel 11. Accordingly, the portable terminal 1 is able to cause the tape printing apparatus 2 to print the enlarged printing image G2 subjected to enlargement processing by using an appropriate enlargement ratio in accordance with the input diameter of the attachment target 200.

Note that, regardless of the embodiment described above, the following modified examples can be employed.

MODIFIED EXAMPLE 1

The portable terminal 1 may display, on the touch panel 11, an input screen (not illustrated) for inputting a radius or a circumference of the attachment target 200 instead of the diameter input screen D2 for inputting the diameter of the attachment target 200. The radius of the attachment target 200 is an example of a size of the attachment target. The radius and the circumference of the attachment target 200 are also examples of enlargement ratio information. In this instance, the portable terminal 1 may determine the enlargement ratio for enlargement processing in accordance with the radius or the circumference of the attachment target 200, which is input via the input screen.

MODIFIED EXAMPLE 2

The printing control section 140 of the portable terminal 1 may determine a printing size of the enlarged printing image G2 in accordance with an input size or circumference of the attachment target 200 and cause the tape printing apparatus 2 to print the enlarged printing image G2 by using the determined printing size. In this instance, the configuration may be such that the printing control section 140 is not able to designate the printing size of the printing image in an editing stage of the printing image before the printing instruction processing illustrated in FIG. 10 starts. Alternatively, the printing control section 140 may receive designation of the printing size of the printing image at an editing stage of the printing image, and when the printing size is changed after a size or a circumference of the attachment target 200 is input, the printing control section 140 may prompt the user to select whether or not to change the printing size, and when the user selects to change the printing size, the printing control section 140 may determine the printing size of the enlarged printing image G2 in accordance with the size or the circumference of the attachment target 200.

In modified example 2, the printing control section 140 may determine the printing size of the enlarged printing image G2 in accordance with a predetermined calculation formula in which the size or the circumference of the attachment target 200 is set as a parameter. For example, the printing control section 140 may determine the printing size of the enlarged printing image G2 such that one-third the circumference of the attachment target 200 or the diameter of the attachment target 200 corresponds to the dimension of the image region GE2 of the enlarged printing image G2 in the Y direction. According to such a configuration, when the tube label L2 is thermally shrunk with the attachment target 200 inserted thereinto, it is possible to suppress a situation in which a Y-direction end portion of the enlarged printing image G2 is not visible due to the excessively large printing size of the enlarged printing size G2 or a situation in which it is difficult to view the enlarged printing image G2 due to the excessively small printing size of the enlarged printing image G2.

In particular, when a code image, such as a two-dimensional code, is printed as the enlarged printing image G2, since viewability of the image is important, the printing size of the enlarged printing image G2 is desired to be determined in accordance with the size or the circumference of the attachment target 200. Thus, the configuration may be such that the printing control section 140 determines whether or not to print a code image, such as a two-dimensional code, in accordance with the result of editing the printing image by the user, and when determining that the code image is printed, the printing control section 140 determines the printing size of the enlarged printing image G2 in accordance with the size or the circumference of the attachment target 200, and when determining that the code image is not printed, the printing control section 140 does not determine the printing size of the enlarged printing image G2 in accordance with the size or the circumference of the attachment target 200.

MODIFIED EXAMPLE 3

The display control section 130 of the portable terminal 1 may cause the touch panel 11 to display a shrinkage ratio input screen (not illustrated) for inputting a shrinkage ratio of the tube tape T2 instead of the diameter input screen D2. Moreover, the shrinkage ratio input screen may enable input of a shrinkage ratio in not only the Y direction but also the X direction. In this instance, the printing control section 140 of the portable terminal 1 may determine the reciprocal of the shrinkage ratio of the attachment target 200 in each of the X direction and the Y direction as the enlargement ratio. According to such a configuration, the portable terminal 1 is able to print, on the tube tape T2, the enlarged printing image G2 obtained by performing enlargement processing for the normal printing image G1 by using the enlargement ratio according to the shrinkage ratio set to the tube tape T2.

MODIFIED EXAMPLE 4

When determining that the tube tape T2 is loaded in the tape cartridge C, the determining section 120 of the portable terminal 1 may determine the shrinkage ratio of the tube tape T2 in accordance with cartridge information. In modified example 4, it is assumed that the cartridge information reading section 42 of the tape printing apparatus 2 reads the shrinkage ratio of the tube tape T2 as a portion of the cartridge information. The printing control section 140 according to modified example 4 determines the enlargement ratio of the enlarged printing image G2 with respect to the normal printing image G1 in accordance with the shrinkage ratio of the tube tape T2, which is determined by the determining section 120, and causes the tape printing apparatus 2 to print the enlarged printing image G2 obtained by enlarging the normal printing image G1 by using the determined enlargement ratio. According to such a configuration, the portable terminal 1 is able to exert an effect equivalent to that of modified example 3 while reducing time and effort for the user to input the shrinkage ratio of the tube tape T2.

MODIFIED EXAMPLE 5

When printing characters, the printing control section 140 of the portable terminal 1 does not necessarily generate the enlarged printing image G2 by performing enlargement processing for the normal printing image G1 and may generate the enlarged printing image G2 by using an enlarged font. In this instance, the portable terminal 1 stores a normal font and the enlarged font as a portion of the label creating application 30. The printing control section 140 generates the normal printing image G1 by using the normal font and generates the enlarged printing image G2 by using the enlarged font. The enlarged font is a font obtained by enlarging the normal font. Note that the portable terminal 1 may store a plurality of types of enlarged fonts having different enlargement ratios as a portion of the label creating application 30. According to such a configuration, the printing control section 140 may determine the enlargement ratio in accordance with the size or the circumference of the attachment target 200 or the shrinkage ratio of the tube tape T2 and generate the enlarged printing image G2 by using the enlarged font suitable for the determined enlargement ratio.

MODIFIED EXAMPLE 6

When determining that the enlarged printing image G2 is printed, the printing control section 140 of the portable terminal 1 is not necessarily configured to generate printing data for printing the enlarged printing image G2 by performing enlargement processing for the normal printing image G1 and to transmit the generated printing data to the tape printing apparatus 2 and may transmit printing data for printing the normal printing image G1 and an enlargement processing instruction to the tape printing apparatus 2. In this instance, after receiving the printing data, the tape printing apparatus 2 may perform enlargement processing for the normal printing image G1 included in the received printing data and thereby generate the enlarged printing image G2.

MODIFIED EXAMPLE 7

The portable terminal 1 may omit either display of the printing image selection screen D1 or display of the diameter input screen D2. For example, in an instance in which display of both the screens is omitted, when determining that the tube tape T2 is loaded in the tape cartridge C attached to the tape printing apparatus 2, the portable terminal 1 causes the tape printing apparatus 2 to print the enlarged printing image G2 automatically.

MODIFIED EXAMPLE 8

The portable terminal 1 may transmit a cartridge information request signal to the tape printing apparatus 2 not only when the user issues a printing instruction but also when the label creating application 30 starts or when an editing screen for editing a printing image is displayed.

MODIFIED EXAMPLE 9

The tape printing apparatus 2 may include a detecting section that detects presence/absence of a convex portion or a concave portion formed in the tape cartridge C instead of the cartridge information reading section 42 and acquire cartridge information from the detection result from the detecting section. Alternatively, the tape printing apparatus 2 may acquire cartridge information from a circuit substrate provided in the case of the tape cartridge C and having a memory element.

MODIFIED EXAMPLE 10

The functional configuration of the portable terminal 1 illustrated in FIG. 7 may be achieved by the tape printing apparatus 2. In this instance, the tape printing apparatus 2 performs printing in accordance with the result of editing the printing image with the keyboard 21. The acquiring section 110 of the tape printing apparatus 2 acquires cartridge information via the cartridge information reading section 42. The display control section 130 of the tape printing apparatus 2 causes the display 22 to display the printing image selection screen D1 and the diameter input screen D2. When determining that the normal printing image G1 is printed, the printing control section 140 of the tape printing apparatus 2 causes the printing section 43 to print the normal printing image G1, and when determining that the enlarged printing image G2 is printed, the printing control section 140 causes the printing section 43 to print the enlarged printing image G2.

OTHER MODIFIED EXAMPLES

The tape printing apparatus 2 performs printing by a thermal transfer method in the embodiment described above but may perform printing by another printing method such as an ink jet method. The tape printing apparatus 2 performs printing by feeding the tape T that is loaded in the case of the tape cartridge C in the embodiment described above but may perform printing by feeding the tape T that is not loaded in the case of the tape cartridge C. The tape printing apparatus 2 creates the strip-like tube label L2 by cutting the elongated tube tape T2 but may create the tube label L2 by performing printing on the tape T in which strip-like tube label members are arranged at a regular interval. The tape printing apparatus 2 may perform printing on not the cylindrical tube tape T2 but a planar thermally shrinkable tape. Further, the tape printing apparatus 2 may perform printing on a shrinkable tape made of a material that is shrunk by a factor other than heat, for example, by curing shrinkage performed by ultraviolet irradiation. Additionally, the foregoing embodiment may be modified within a range of not departing from the gist of the disclosure.

Additional Notes

Hereinafter, additional notes on an information processing apparatus, a tape printing apparatus, a tape printing system, a control method of the information processing apparatus, and a non-transitory computer-readable storage medium storing a program will be described.

The portable terminal 1 is communicably coupled to the tape printing apparatus 2 to which the tape cartridge C is attached and which prints a printing image on the tape T fed from the tape cartridge C, and the portable terminal 1 includes: the acquiring section 110 that acquires cartridge information indicating a type of the tape cartridge C attached to the tape printing apparatus 2; the determining section 120 that determines whether or not the shrinkable tube tape T2 is loaded in the tape cartridge C in accordance with the cartridge information; and the printing control section 140 that, when the determining section 120 determines that the tube tape T2 is not loaded in the tape cartridge C, causes the tape printing apparatus 2 to print the normal printing image G1 and, when the determining section 120 determines that the tube tape T2 is loaded in the tape cartridge C, causes the tape printing apparatus 2 to print the enlarged printing image G2 to be printed on the tape T as an enlarged image of the normal printing image G1.

In the tape printing system SY in which the tape printing apparatus 2 to which the tape cartridge C is attached and which prints a printing image on the tape T fed from the tape cartridge C and the portable terminal 1 are communicably coupled, the portable terminal 1 includes: the acquiring section 110 that acquires cartridge information indicating a type of the tape cartridge C attached to the tape printing apparatus 2; the determining section 120 that determines whether or not the shrinkable tube tape T2 is loaded in the tape cartridge C in accordance with the cartridge information; and the printing control section 140 that, when the determining section 120 determines that the tube tape T2 is not loaded in the tape cartridge C, causes the tape printing apparatus 2 to print the normal printing image G1 and, when the determining section 120 determines that the tube tape T2 is loaded in the tape cartridge C, causes the tape printing apparatus 2 to print the enlarged printing image G2 to be printed on the tape T as an enlarged image of the normal printing image G1.

In a control method of the portable terminal 1 communicably coupled to the tape printing apparatus 2 to which the tape cartridge C is attached and which prints a printing image on the tape T fed from the tape cartridge C, the portable terminal 1: acquires cartridge information indicating a type of the tape cartridge C attached to the tape printing apparatus 2; determines whether or not the shrinkable tube tape T2 is loaded in the tape cartridge C in accordance with the cartridge information; and when it is determined that the tube tape T2 is not loaded in the tape cartridge C, causes the tape printing apparatus 2 to print the normal printing image G1 and, when it is determined that the tube tape T2 is loaded in the tape cartridge C, causes the tape printing apparatus 2 to print the enlarged printing image G2 to be printed on the tape T as an enlarged image of the normal printing image G1.

The label creating application 30 causes the portable terminal 1 communicably coupled to the tape printing apparatus 2 to which the tape cartridge C is attached and which prints a printing image on the tape T fed from the tape cartridge C to: acquire cartridge information indicating a type of the tape cartridge C attached to the tape printing apparatus 2; determine whether or not the shrinkable tube tape T2 is loaded in the tape cartridge C in accordance with the cartridge information; and when it is determined that the tube tape T2 is not loaded in the tape cartridge C, cause the tape printing apparatus 2 to print the normal printing image G1 and, when it is determined that the tube tape T2 is loaded in the tape cartridge C, cause the tape printing apparatus 2 to print the enlarged printing image G2 to be printed on the tape T as an enlarged image of the normal printing image G1.

When determining that the tube tape T2 is loaded in the tape cartridge C attached to the tape printing apparatus 2, the portable terminal 1 causes the tape printing apparatus 2 to print the enlarged printing image G2 to be printed on the tape T as the enlarged image of the normal printing image G1. According to such a configuration, it is possible to cause the tape printing apparatus 2 to print an appropriate printing image in accordance with a type of the tape cartridge C.

The portable terminal 1 described above may further include the display control section 130 that, when the determining section 120 determines that the tube tape T2 is loaded in the tape cartridge C, causes the display section to display the printing image selection screen D1 enabling the user to select whether to print the normal printing image G1 or the enlarged printing image G2, in which when printing of the normal printing image G1 is selected on the printing image selection screen D1, the printing control section 140 may cause the tape printing apparatus 2 to print the normal printing image G1, and when printing of the enlarged printing image G2 is selected on the printing image selection screen D1, the printing control section 140 may cause the tape printing apparatus 2 to print the enlarged printing image G2.

According to such a configuration, when determining that the tube tape T2 is loaded in the tape cartridge C attached to the tape printing apparatus 2, the portable terminal 1 displays the printing image selection screen D1 enabling the user to select whether to print the normal printing image G1 or the enlarged printing image G2. Accordingly, the user is able to select whether to print the normal printing image G1 or the enlarged printing image G2 in accordance with preference of the user.

In the portable terminal 1 described above, when printing of the enlarged printing image G2 is selected on the printing image selection screen D1, the display control section 130 may cause the touch panel 11 to display the input screen enabling the user to input enlargement ratio information as information for determining an enlargement ratio of the enlarged printing image G2 with respect to the normal printing image G1, and the printing control section 140 may determine the enlargement ratio in accordance with the enlargement ratio information input via the input screen and cause the tape printing apparatus 2 to print the enlarged printing image G2 obtained by enlarging the normal printing image G1 by using the determined enlargement ratio.

According to such a configuration, the portable terminal 1 is able to cause the tape printing apparatus 2 to print the enlarged printing image G2 obtained by enlarging the normal printing image G1 by using an appropriate enlargement ratio in accordance with the enlargement ratio information input via the input screen.

In the portable terminal 1 described above, the tube tape T2 may be a tape for creating the tube label L2 into which an object is inserted, and the display control section 130 may cause the touch panel 11 to display the input screen enabling the user to input a size or a circumference of the object as the enlargement ratio information.

According to such a configuration, the portable terminal 1 is able to cause the tape printing apparatus 2 to print the enlarged printing image G2 obtained by enlarging the normal printing image G1 by using an appropriate enlargement ratio in accordance with the input size or circumference of the object.

In the portable terminal 1 described above, the display control section 130 may cause the touch panel 11 to display the input screen enabling the user to input a shrinkage ratio of the tube tape T2 as the enlargement ratio information.

According to such a configuration, the portable terminal 1 is able to cause the tape printing apparatus 2 to print the enlarged printing image G2 obtained by enlarging the normal printing image G1 by using an appropriate enlargement ratio in accordance with the input shrinkage ratio of the tube tape T2.

In the portable terminal 1 described above, when determining that the tube tape T2 is loaded in the tape cartridge C, the determining section 120 may determine a shrinkage ratio of the tube tape T2 in accordance with the cartridge information, and the printing control section 140 may determine an enlargement ratio of the enlarged printing image G2 with respect to the normal printing image G1 in accordance with the shrinkage ratio of the tube tape T2, which is determined by the determining section 120, and cause the tape printing apparatus 2 to print the enlarged printing image G2 obtained by enlarging the normal printing image G1 by using the determined enlargement ratio.

According to such a configuration, the portable terminal 1 is able to cause the tape printing apparatus 2 to print the enlarged printing image G2 obtained by enlarging the normal printing image G1 by using an appropriate enlargement ratio in accordance with the shrinkage ratio of the tube tape T2 determined in accordance with the cartridge information.

The tape printing apparatus 2 to which the tape cartridge C is attached includes: the printing section 43 that prints a printing image on the tape T fed from the tape cartridge C; the acquiring section 110 that acquires cartridge information indicating a type of the tape cartridge C attached to the tape printing apparatus 2; the determining section 120 that determines whether or not the shrinkable tube tape T2 is loaded in the tape cartridge C in accordance with the cartridge information; and the printing control section 140 that, when the determining section 120 determines that the tube tape T2 is not loaded in the tape cartridge C, causes the printing section 43 to print the normal printing image G1 and, when the determining section 120 determines that the tube tape T2 is loaded in the tape cartridge C, causes the printing section 43 to print the enlarged printing image G2 to be printed on the tape T as an enlarged image of the normal printing image G1.

According to such a configuration, when determining that the tube tape T2 is loaded in the attached tape cartridge C, the tape printing apparatus 2 causes the printing section 43 to print the enlarged printing image G2 to be printed on the tape T as the enlarged image of the normal printing image G1. According to such a configuration, it is possible to cause the printing section 43 to print an appropriate printing image in accordance with a type of the tape cartridge C.

What is claimed is:

1. An information processing apparatus coupled to and configured to communicate with a tape printing apparatus to which a tape cartridge is attached and which prints a printing image on a tape fed from the tape cartridge, the information processing apparatus comprising:

an acquiring section that acquires cartridge information indicating a type of the tape cartridge attached to the tape printing apparatus;

a determining section that determines whether or not a shrinkable tape is loaded in the tape cartridge in accordance with the cartridge information;

a printing control section that, when the determining section determines that the shrinkable tape is not loaded in the tape cartridge, causes the tape printing apparatus to print a normal printing image and, when the determining section determines that the shrinkable tape is loaded in the tape cartridge, enables the tape printing apparatus to print an enlarged printing image to be printed on the tape as an enlarged image of the normal printing image; and a display control section that, when the determining section determines that the shrinkable tape is loaded in the tape cartridge, causes a display section to display a selection screen enabling a user to select whether to print the normal printing image or the enlarged printing image, wherein when printing of the normal printing image is selected on the selection screen, the printing control section causes the tape printing apparatus to print the normal printing image on the shrinkable tape, and when printing of the enlarged printing image is selected on the selection screen, the printing control section causes the tape printing apparatus to print the enlarged printing image on the shrinkable tape.

2. The information processing apparatus according to claim 1, wherein when printing of the enlarged printing image is selected on the selection screen, the display control section causes the display section to display an input screen enabling the user to input enlargement ratio information as information for determining an enlargement ratio of the enlarged printing image with respect to the normal printing image, and the printing control section determines the enlargement ratio in accordance with the enlargement ratio information input via the input screen and causes the tape printing apparatus to print the enlarged printing image obtained by enlarging the normal printing image by using the enlargement ratio that is determined.

3. The information processing apparatus according to claim 2, wherein the shrinkable tape is a tape for creating a tube label into which an object is inserted, and the display control section causes the display section to display the input screen enabling the user to input a size or a circumference of the object as the enlargement ratio information.

4. The information processing apparatus according to claim 2, wherein the display control section causes the display section to display the input screen enabling the user to input a shrinkage ratio of the shrinkable tape as the enlargement ratio information.

5. The information processing apparatus according to claim 1, wherein when determining that the shrinkable tape is loaded in the tape cartridge, the determining section determines a shrinkage ratio of the shrinkable tape in accordance with the cartridge information, and the printing control section determines an enlargement ratio of the enlarged printing image with respect to the normal printing image in accordance with the shrinkage ratio of the shrinkable tape, which is determined by the determining section, and causes the tape printing apparatus to print the enlarged printing image obtained by enlarging the normal printing image by using the enlargement ratio that is determined.

6. A tape printing apparatus to which a tape cartridge is attached, the tape printing apparatus comprising:

a printing section that prints a printing image on a tape fed from the tape cartridge;

an acquiring section that acquires cartridge information indicating a type of the tape cartridge attached to the tape printing apparatus;

a determining section that determines whether or not a shrinkable tape is loaded in the tape cartridge in accordance with the cartridge information;

a printing control section that, when the determining section determines that the shrinkable tape is not loaded in the tape cartridge, causes the printing section to print a normal printing image and, when the determining section determines that the shrinkable tape is loaded in the tape cartridge, enables the printing section to print an enlarged printing image to be printed on the tape as an enlarged image of the normal printing image; and a display control section that, when the determining section determines that the shrinkable tape is loaded in the tape cartridge, causes a display section to display a selection screen enabling a user to select whether to print the normal printing image or the enlarged printing image, wherein when printing of the normal printing image is selected on the selection screen, the printing control section causes the tape printing apparatus to print the normal printing image on the shrinkable tape, and when printing of the enlarged printing image is selected on the selection screen, the printing control section causes the tape printing apparatus to print the enlarged printing image on the shrinkable tape.

7. A tape printing system in which a tape printing apparatus, to which a tape cartridge is attached and which prints a printing image on a tape fed from the tape cartridge, and an information processing apparatus are coupled to and configured to communicate with each other, the information processing apparatus including an acquiring section that acquires cartridge information indicating a type of the tape cartridge attached to the tape printing apparatus, a determining section that determines whether or not a shrinkable tape is loaded in the tape cartridge in accordance with the cartridge information, a printing control section that, when the determining section determines that the shrinkable tape is not loaded in the tape cartridge, causes the tape printing apparatus to print a normal printing image and, when the determining section determines that the shrinkable tape is loaded in the tape cartridge, enables the tape printing apparatus to print an enlarged printing image to be printed on the tape as an enlarged image of the normal printing image; and a display control section that, when the determining section determines that the shrinkable tape is loaded in the tape cartridge, causes a display section to display a selection screen enabling a user to select whether to print the normal printing image or the enlarged printing image, wherein when printing of the normal printing image is selected on the selection screen, the printing control section causes the tape printing apparatus to print the normal printing image on the shrinkable tape, and when printing of the enlarged printing image is selected on the selection screen, the printing control section causes the tape printing apparatus to print the enlarged printing image on the shrinkable tape.

8. A control method of an information processing apparatus coupled to and configured to communicate with a tape printing apparatus to which a tape cartridge is attached and which prints a printing image on a tape fed from the tape cartridge, the method causing the information processing apparatus to execute a step of:

acquiring cartridge information indicating a type of the tape cartridge attached to the tape printing apparatus;

determining whether or not a shrinkable tape is loaded in the tape cartridge in accordance with the cartridge information;

when it is determined that the shrinkable tape is not loaded in the tape cartridge, causing the tape printing apparatus to print a normal printing image and, when it is determined that the shrinkable tape is loaded in the tape cartridge, enabling the tape printing apparatus to print an enlarged printing image to be printed on the tape as an enlarged image of the normal printing image;

when it is determined that the shrinkable tape is loaded in the tape cartridge, causing a display section to display a selection screen enabling a user to select whether to print the normal printing image or the enlarged printing image; and when printing of the normal printing image is selected on the selection screen, causing the tape printing apparatus to print the normal printing image on the shrinkable tape, and when printing of the enlarged printing image is selected on the selection screen, causing the tape printing apparatus to print the enlarged printing image on the shrinkable tape.

9. A non-transitory computer-readable storage medium storing a program causing an information processing apparatus coupled to and configured to communicate with a tape printing apparatus to which a tape cartridge is attached and which prints a printing image on a tape fed from the tape cartridge to execute a step of:

acquiring cartridge information indicating a type of the tape cartridge attached to the tape printing apparatus;

determining whether or not a shrinkable tape is loaded in the tape cartridge in accordance with the cartridge information;

when it is determined that the shrinkable tape is not loaded in the tape cartridge, causing the tape printing apparatus to print a normal printing image and, when it is determined that the shrinkable tape is loaded in the tape cartridge, enabling the tape printing apparatus to print an enlarged printing image to be printed on the tape as an enlarged image of the normal printing image;

when it is determined that the shrinkable tape is loaded in the tape cartridge, causing a display section to display a selection screen enabling a user to select whether to print the normal printing image or the enlarged printing image; and when printing of the normal printing image is selected on the selection screen, causing the tape printing apparatus to print the normal printing image on the shrinkable tape, and when printing of the enlarged printing image is selected on the selection screen, causing the tape printing apparatus to print the enlarged printing image on the shrinkable tape.

* * * * *